US009050817B2

(12) United States Patent
Wang

(10) Patent No.: US 9,050,817 B2
(45) Date of Patent: Jun. 9, 2015

(54) STORAGE DEVICE AND CONSUMPTION CONTAINER

(75) Inventor: Dongjie Wang, Guangdong (CN)

(73) Assignee: APEX MICROELECTRONICS COMPANY LIMITED, Guangdong (CN)

( * ) Notice: Subject to any disclaimer, the term of this patent is extended or adjusted under 35 U.S.C. 154(b) by 0 days.

(21) Appl. No.: 14/239,185

(22) PCT Filed: Jun. 26, 2012

(86) PCT No.: PCT/CN2012/077534

§ 371 (c)(1),
(2), (4) Date: Feb. 17, 2014

(87) PCT Pub. No.: WO2013/067818

PCT Pub. Date: May 16, 2013

(65) Prior Publication Data

US 2014/0204138 A1 Jul. 24, 2014

(30) Foreign Application Priority Data

Nov. 8, 2011 (CN) ..... 2011 1 0351168

(51) Int. Cl.
*B41J 29/38* (2006.01)
*B41J 2/175* (2006.01)
*G03G 21/14* (2006.01)

(52) U.S. Cl.
CPC ..... *B41J 2/17566* (2013.01); *G03G 21/14* (2013.01); *B41J 2/17546* (2013.01)

(58) Field of Classification Search
USPC ..... 347/5, 7, 9, 19
See application file for complete search history.

(56) References Cited

U.S. PATENT DOCUMENTS 7,192,108 B2 * 3/2007 Lyman ..... 347/7
2005/0128228 A1 6/2005 Inoue
2009/0141056 A1 6/2009 Nakamura et al.

(Continued)

FOREIGN PATENT DOCUMENTS

CN 101692347 A 4/2010
CN 101913292 A 12/2010

(Continued)

OTHER PUBLICATIONS

International Search Report for PCT/CN2012/077534 mailed Nov. 8, 2012.

(Continued)

*Primary Examiner* — Lam Nguyen
(74) *Attorney, Agent, or Firm* — RatnerPrestia

(57) ABSTRACT

A storage device includes an interface unit, a storage unit, a detection unit and a control unit. When the detection unit detects a preset trigger condition and the total surplus of the recording material is greater than the capacity of the recording material, the control unit effects the updating of the total surplus of the recording material stored in the storage unit and the erasing of the surplus of the erasable recording material or the consumption amount of the erasable recording material as a calculation value. When the total surplus of the recording material is less than or equal to the capacity of the recording material, the control unit will not actively update the total surplus of the recording material or the consumption amount of the recording material in the storage unit. Provided is a consumption container, which can better manage the data in the storage device.

12 Claims, 3 Drawing Sheets

(56) References Cited

U.S. PATENT DOCUMENTS

| | | | | |
|---|---|---|---|---|
| 2009/0295849 | A1 | 12/2009 | Ito | |
| 2009/0322806 | A1* | 12/2009 | Donahue et al. | 347/7 |
| 2011/0193901 | A1* | 8/2011 | Martinez et al. | 347/7 |

FOREIGN PATENT DOCUMENTS

| | | | |
|---|---|---|---|
| CN | 201955625 | U | 8/2011 |
| CN | 102173208 | A | 9/2011 |
| CN | 102180021 | A | 9/2011 |
| CN | 102205728 | A | 10/2011 |
| CN | 102501613 | A | 6/2012 |
| EP | 1 080 912 | A2 | 3/2001 |
| JP | 2004-195814 | A | 7/2004 |
| JP | 2007-130897 | A | 5/2007 |

OTHER PUBLICATIONS

Written Opinion of the International Searching Authority for PCT/CN2012/-77534 dated Sep. 3, 2012.

* cited by examiner

| Address | High Bit 7 | 6 | 5 | 4 | 3 | 2 | 1 | Low Bit 0 |
|---|---|---|---|---|---|---|---|---|
| A0 | Model of the applicable printing apparatus or consumable container | | | | | | | |
| A1 | Identification serial number | | | | | | | |
| A2 | Consumption or remaining amount of the recording material | | | | | | | |
| A3 | Color of the recording material | | | | Parameter K | | | |
| ---- | --------- | | | | | | | |

Figure 2

STORAGE DEVICE AND CONSUMPTION CONTAINER

This application is the U.S. National Phase of International Application No. PCT/CN2012/077534 filed on Jun. 26, 2012, which claims the benefit of priority to Chinese Patent Application No. 201110351168.3, entitled "STORAGE DEVICE AND CONSUMABLE CONTAINER", filed with the Chinese Patent Office on Nov. 8, 2011, which are incorporated herein by reference in their entireties.

FIELD OF THE INVENTION

The invention relates to the field of consumable equipment, in particular to a storage device and a consumable container comprising the same.

BACKGROUND OF THE INVENTION

Printing devices such as duplicating machines, inkjet printers, laser printers and the like are commonly used in offices. Consumable containers of the printing devices include ink cartridges, toner cartridges and the like, and consumables of the printing devices are mainly ink or toner used for recording images. For the convenience of management, a consumable container is usually provided with a storage device for controlling the matching of the consumable container and the printing device and supplying data in the subsequent printing process. The storage device stores the date relating to the consumable container, Which includes: initial data of the consumable container such as the model of the consumable container, a color of a refilled recording material and the capacity of the recording material, and updated data to the initial printing date, the remaining amount of the recording material and the like updated in the printing process. In addition, the printing device further stores the initial data such as the predetermined model of the consumable container and the color of the recording material.

In the beginning of printing, the printing device transmits a read signal to the storage device arranged on the consumable container. After receiving the read signal, the storage device generates a read signal response according to an initial data stored and transmits the same to the printing device. The printing device compares an initial data stored for verifying the consumable container with the received read signal response, and is controlled to record images and texts on a recording medium such as paper after successful matching. During the printing or after the printing, the printing device writes the updated data relating to the initial printing date and the remaining amount of the recording material into the storage device, or updates the information at corresponding positions of the storage device.

If the data relating to the remaining amount of the recording material, read by the printing device from the storage device arranged on the consumable container, indicates the insufficiency of the remaining amount of the recording material, the printing device may remind a user of replacing the consumable container or stopping printing. For example, during the operation of the consumable container, if the data relating to the remaining amount of the recording material, stored in the storage device arranged on the consumable container, is 100 if the recording material is sufficient, and is 0 if the recording material is used up, the printing device may stop imaging or remind the user of replacing a new consumable container if the data relating to the remaining amount of the recording material in the storage device is detected as 0. That is to say, even if a large amount of recording material is remained in the consumable container, the consumable container cannot be continuously used for printing or imaging if the data relating to the remaining amount of the recording material in the storage device indicates the insufficiency of the recording material. In this case, the recording material may be wasted.

The capacity of the recording material in consumable containers manufactured or improved by aftermarket manufacturers is usually different from that of the recording material in consumable containers manufactured by the original manufacturers. As for a consumable container with different recording material capacity with the original one, the data relating to the remaining amount of the recording material stored in the original storage device are not matched with the capacity of the recording material in the consumable container. As such, there may be a large amount of recording materials in the consumable container if the remaining amount of the recording material in the storage device is insufficient.

In order to solve the problem, the aftermarket manufacturers design a storage device of which the capacity is more than the capacity of the recording material in the original consumable container.

The first proposal is that: different storage areas are arranged in the storage device and used for respectively storing a plurality of sets of data relating to the consumable containers, and data stored into other areas can be continuously used after one set of data are rewritten by the printing device, so that one storage device can be used repeatedly.

The second proposal is that: a control circuit is arranged in the storage device and a plurality of parameters are set for the storage device. For example, a reset threshold value is set, if the printing device updates the data relating to the remaining amount of the recording material in the storage device during printing or after printing and the updated data reaches or exceeds the reset threshold value, the control circuit controls the initialization of the partial data stored in the storage device, and the storage device can continue to operate and be matched with the printing device to consume the recording material in the consumable container.

For the first proposal, as a large-capacity memory is required to be used for storing a plurality of sets of data relating to the consumable container, the cost of printing consumables cannot be reduced.

For the second proposal, as a printing device rewrites the data relating to the remaining amount of the recording material in the storage device only after each printing operation, the following cases may occur. For example, the capacity of the consumable container of the printing device shows the capability of printing 150 pages but the storage device can only be used for printing 100 pages, the number of pages having been printed of the storage device is preset to be 0; the reset threshold value of the number of the pages which have been printed is 50; and the reset frequency is limited to be 1. Theoretically, the storage device may reset the number of the pages which have been printed to be 0 if 50 pages have been printed by the printing device, and subsequently, the printing device may also use the storage device for continuous printing of 100 pages, in which case the recording material of the consumable container may be just used up. However, if more than 50 pages are printed by the printing apparatus in one printing operation, as the printing apparatus updates the data in the storage device only after the end of each printing operation, when the number of the pages which have been printed is rewritten to, for example, 70, the storage device executes the reset operation and resets the number of the pages having been printed to be 0 when detecting that the number exceeds the reset threshold value. In this case, the recording material in the consumable container may have been used up and cannot be used for continuous printing when the printing apparatus detects that the storage device may further be used for printing 20 pages. More severely, the storage device does not execute the reset operation when the number exceeds the reset threshold value. Therefore, unnecessary trade disputes tend to occur due to the large deviation between the capacity of the sold consumable container and the set capacity of the recording material in the storage device.

The above analysis is provided by taking the example of only storing the consumption of the recording material into the storage device. As for storage devices only storing the remaining amount of the recording material or storing both the consumption and the remaining amount of the recording material, there are similar problems.

Therefore, how to manage the data in the storage device better is a technical problem to be solved by those skilled in the art.

SUMMARY OF THE INVENTION

The technical problem to be solved by the present invention is to provide a storage device for better management of data therein in such a way that the data stored into the storage device are consistent with the actual remaining amount or the actual consumption of a recording material in consumable device.

According to the present invention, it is provided a storage device, which includes:

an interface unit;

a storage unit, adapted to store a total remaining amount of a recording material and a capacity of the recording material, an initial remaining amount of the recording material and/or an initial consumption of the recording material, and a rewritable remaining amount of the recording material and/or a rewritable consumption of the recording material;

a detection unit, adapted to detect a signal of the interface unit; and a control unit, adapted to control updating the total remaining amount of the recording material stored in the storage unit, rewrite the rewritable remaining amount of the recording material into a calculated value of the rewritable remaining amount of the recording material or rewrite the rewritable consumption of the recording material into a calculated value of the rewritable consumption of the recording material, in the case that the detection unit detects a predetermined trigger condition and the total remaining amount of the recording material is more than the capacity of the recording material; and adapted to non-spontaneously update the remaining amount of the recording material or the consumption of the recording material stored in the storage unit in the case that the total remaining amount of the recording material is less than or equal to the capacity of the recording material.

Preferably, the predetermined trigger condition is that the detection unit detects a change of a signal transmitted to the interface unit by a printing device, wherein the signal comprises voltage fall or voltage rise of the interface unit due to switching of the printing device, replacement of a consumable container, or opening of a protective cover of the consumable container.

Preferably, the capacity of the recording material is identical with the initial remaining amount of the recording material, the capacity of the recording material and the initial remaining amount of the recording material are a same parameter, or the capacity of the recording material is identical with a maximum of the rewritable consumption of the recording material.

Preferably, the calculated value of the rewritable consumption of the recording material is identical with a value of the initial consumption of the recording material; or the calculated value of the rewritable remaining amount of the recording material is identical with the value of the initial remaining amount of the recording material.

Preferably, an updated total remaining amount of the recording material=the total remaining amount of the recording material−the rewritable consumption of the recording material, the updated total remaining amount of the recording material=the total remaining amount of the recording material−a variation of the consumption of the recording material, or the updated total remaining amount of the recording material=the total remaining amount of the recording material−a variation of the remaining amount of the recording material.

Preferably, the calculated value includes:

the calculated value of the rewritable consumption of the recording material is identical with a value of the initial consumption of the recording material in the case that the rewritable consumption of the recording material is less than or equal to a difference between the total remaining amount of the recording material and the capacity of the recording material, the calculated value of the rewritable consumption of the recording material is identical with the value of the initial consumption of the recording material in the case that the variation of the consumption of the recording material is less than or equal to the difference between the total remaining amount of the recording material and the capacity of the recording material, or the calculated value of the rewritable remaining amount of the recording material is identical with the value of the initial remaining amount of the recording material in the case that the variation of the remaining amount of the recording material is less than or equal to a difference between the total remaining amount of the recording material and the initial remaining amount of the recording material; and the calculated value of the rewritable consumption of the recording material is identical with a difference between the capacity of the recording material and the updated total remaining amount of the recording material in the case that the rewritable consumption of the recording material is more than the difference between the total remaining amount of the recording material and the capacity of the recording material, the calculated value of the rewritable consumption of the recording material is identical with the difference between the capacity of the recording material and the updated total remaining amount of the recording material in the case that the variation of the consumption of the recording material is more than the difference between the total remaining amount of the recording material and the capacity of the recording material, or the calculated value of the rewritable remaining amount of the recording material is identical with the updated total remaining amount of the recording material in the case that the variation of the remaining amount of the recording material is more than the difference between the total remaining amount of the recording material and the initial remaining amount of the recording material;

herein, the variation of the consumption of the recording material is a difference between the rewritable consumption of the recording material and the initial consumption of the recording material, and the variation of the remaining amount of the recording material is a difference between the initial remaining amount of the recording material and the rewritable remaining amount of the recording material.

According to the present invention, it is further provided a consumable container, which includes the storage device stated above.

According to the present invention, it is provided another storage device, which includes:

an interface unit;

a storage unit, adapted to store a target consumption of a recording material, a accumulative consumption of the recording material, a capacity of the recording material, an initial remaining amount of the recording material and/or an initial consumption of the recording material, and a rewritable remaining amount of the recording material and/or a rewritable consumption of the recording material;

a detection unit, adapted to detect a signal of the interface unit; and a control unit, adapted to control updating the accumulative consumption of the recording material stored in the storage unit, rewrite the rewritable remaining amount of the recording material into a calculated value of the rewritable remaining amount of the recording material or rewrite the rewritable consumption of the recording material into a calculated value of the rewritable consumption of the recording material, in the case that the detection unit detects a predetermined trigger condition and the accumulative consumption of the recording material is less than an additional amount of the recording material; and adapted to non-spontaneously update the remaining amount or the consumption of the recording material stored in the storage unit in the case that the accumulative consumption of the recording material is more than or equal to the additional amount of the recording material;

herein the additional amount of the recording material is a difference between the target consumption of the recording material and the capacity of the recording material.

Preferably, an updated accumulative consumption of the recording material=the accumulative consumption of the recording material+the rewritable consumption of the recording material, the updated accumulative consumption of the recording material=the accumulative consumption of the recording material+a variation of the consumption of the recording material, or the updated accumulative consumption of the recording material=the accumulative consumption of the recording material+a variation of the remaining amount of the recording material;

herein, the variation of the consumption of the recording material is a difference between the rewritable consumption of the recording material and the initial consumption of the recording material, and the variation of the remaining amount of the recording material is a difference between the initial remaining amount of the recording material and the rewritable remaining amount of the recording material.

Preferably, the calculated value of the rewritable consumption of the recording material is identical with a value of the initial consumption of the recording material, or the calculated value of the rewritable remaining amount of the recording material is identical with a value of the initial remaining amount of the recording material.

Preferably, the rewritable consumption of the recording material is rewritten into a value identical with the value of initial consumption of the recording material in the case that the updated accumulative consumption of the recording material is less than the additional amount of the recording material, or the rewritable remaining amount of the recording material is rewritten into a value identical with the value of the initial remaining amount of the recording material in the case that the updated accumulative consumption of the recording material is less than the additional amount of the recording material; and the rewritable consumption of the recording material is rewritten into a difference between the capacity of the recording material and the remaining consumable amount of the recording material in the case that the updated accumulative consumption of the recording material is more than or equal to the additional amount of the recording material, or the rewritable remaining amount of the recording material is rewritten into a value identical with the value of the remaining consumable amount of the recording material in the case that the updated accumulative consumption of the recording material is more than or equal to the additional amount of the recording material;

herein, the remaining consumable amount of the recording material is a difference between the target consumption of the recording material and the updated accumulative consumption of the recording material.

According to the present invention, it is provided another consumable container, which includes the storage device stated above.

Compared with the prior art, the present invention has the advantages that:

according to the storage device of the present invention, if the detection unit detects a predetermined trigger condition and the total remaining amount of the recording material is more than the capacity of the recording material, the control unit may update the total remaining amount of the recording material stored in the storage unit and rewrite the rewritable remaining amount or the rewritable consumption of the recording material into a calculated value. however, in the prior art, the data in the storage device can only be spontaneously modified if it reaches the specific threshold value; and if the total remaining amount of the recording material is less than or equal to the capacity of the recording material, the control unit non-spontaneously updates the remaining amount or the consumption of the recording material stored in the storage unit. The storage device according to the present invention automatically rewrites the stored data when the predetermined trigger condition is satisfied, ensures the consistency of the actual remaining amount or the actual consumption of the recording material in the consumable equipment and those recorded in the storage device or ensures small deviations, and achieves scientific management of the data in the storage device.

BRIEF DESCRIPTION OF THE DRAWINGS

FIG. 2 is a mapping view of a storage area of a storage unit according to an embodiment of the present invention.

DETAILED DESCRIPTION

According to the present invention, it is provided a storage device and consumable device for better management of data in the storage device, and in such a way that the data in the storage device is consistent with the actual remaining amount or the actual consumption of a recording material in the consumable device or have small deviations therebetween.

The specific embodiments of the present invention are described in detail below with reference to the accompanying drawings to give a clear and easy understanding of the objectives, characteristics and advantages of the present invention.

Figure 1:
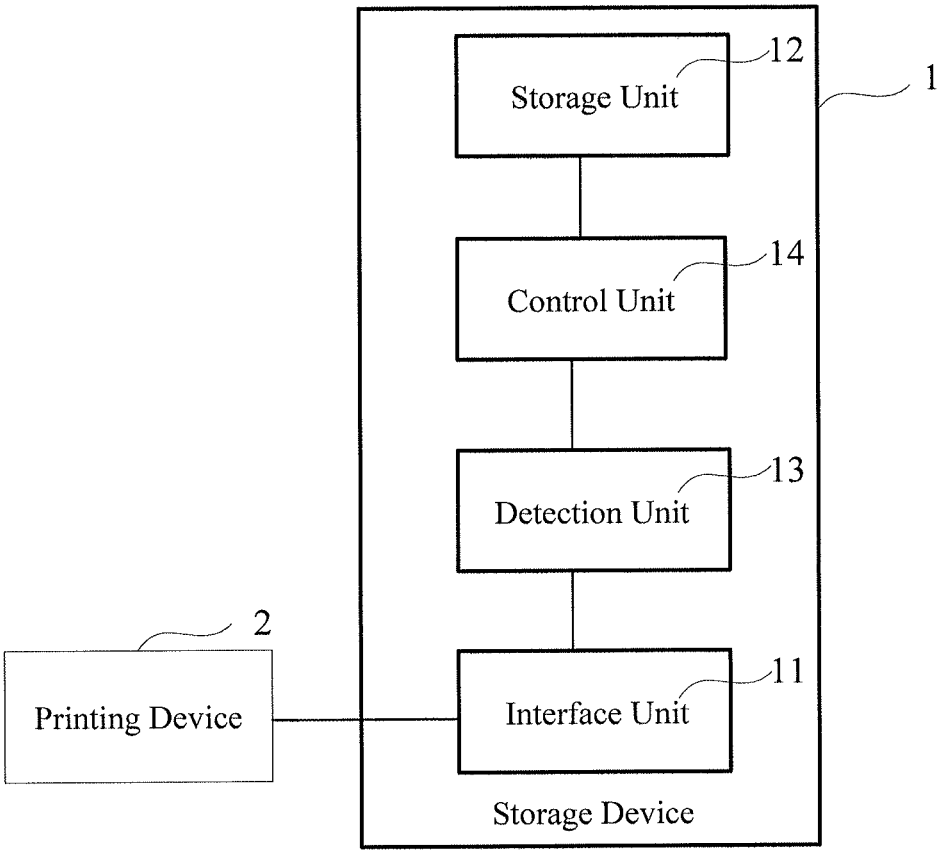
FIG. 1 is a structural view of a storage device according to an embodiment of the present invention.

Only several components in FIG. 1 are illustrated for convenient description of the technical proposals of the invention. As for different types of storage devices, other components may be also provided, for example, a light-emitting unit, an independent power supply unit and the like.

Referring to FIG. 1, which is a structural view of a storage device according to an embodiment of the present invention.

A storage device 1 according to a first embodiment of the present invention includes an interface unit 11, a storage unit 12, a detection unit 13 and a control unit 14.

The interface unit 11 is adapted to establish a communication connection between the storage device 1 and a printing device 2.

The interface unit 11 may be provided with a plurality of connecting terminals for the wired communication mode and may be provided with a signal transmitting and receiving antenna or element for the wireless communication mode.

The storage unit 12 is adapted to store the total remaining amount and the capacity of a recording material, the initial remaining amount and/or the initial consumption of the recording material, and the rewritable remaining amount and/or the rewritable consumption of the recording material.

The total remaining amount of the recording material refers to the total amount of the recording material accommodated in a compatible consumable container or the total amount of the available recording material corresponding to the storage device 1. Accordingly, the data range of the total consumption and the target consumption of the recording material described below is identical with that of the total remaining amount of the recording material. The total remaining amount of the recording material is gradually reduced and the total consumption and the target consumption of the recording material are accumulatively increased, so the essence is the same with each other.

The capacity of the recording material refers to the maximum of the recording material set by the original manufacturer for the consumable container manufactured by the manufacturer, and corresponds to an initial value of the remaining amount of the recording material in the storage device 1 manufactured by the original manufacturer or the consumption of the recording material after the recording material in the consumable container manufactured by the original manufacturer is used up, namely is identical with the maximum of the rewritable consumption of the recording material. In addition, the capacity of the recording material may also be set during the production process and may be more or less than the maximum of the recording material set by the original manufacturer for the consumable container manufactured for the storage device, according to the actual need.

In general, the storage unit 12 is adapted to store data relating to the consumable container. For example, as for an ink cartridge taken as an ink container, the storage unit 12 is adapted to store the model of the ink cartridge, the applicable printer, the color of the ink taken as the recording material, the capacity of the ink in the ink cartridge, the remaining amount of the available ink, and the like.

According to the present invention, the rewritable remaining amount or the rewritable consumption of the recording material stored in the storage unit are two parameters set by the original manufacturer for recording the usage condition of the recording material, for example, the remaining amount of the available ink.

As illustrated in FIG. 2 which is a mapping view of a storage area of the storage unit in the storage device according to the present invention. The storage unit has a plurality of rows in arrangement, with one byte (i.e. 8 bits) in one row. In FIG. 2, the initial data of the consumable container are stored in rows A0, A1 and A3, and the rewritable remaining amount or the rewritable consumption of the recording material is stored in row A2.

In other storage devices 1, a same parameter may be partitioned and stored at a plurality of positions. For example, the parameter K in A3 row may be one part of the parameter in row A2 or taken as a check code. In the present invention, the initial remaining amount and the rewritable remaining amount of the recording material are respectively stored in the storage unit 12. In addition, in other storage devices 1, the initial consumption and the rewritable consumption of the recording material may also be respectively stored in the storage unit 12, or only the initial consumption and the rewritable consumption of the recording material are respectively stored.

In the embodiment of the present invention, if the storage device 1 is bran-new, namely if the storage device 1 is not used or initially mounted on the printing device 2, the initial remaining amount and the rewritable remaining amount of the recording material stored in the storage unit 12 are identical, or the initial consumption and the rewritable consumption of the recording material stored in the storage unit 12 are identical. It is apparent that besides storing the rewritable remaining amount or the rewritable consumption of the recording material which is also set by the original manufacturer, the storage unit 12 of the storage device 1 of the embodiment of the present invention also stores the initial value thereof which is taken as the initial remaining amount or the initial consumption of the recording material.

The detection unit 13 is adapted to detect a signal of the interface unit 11.

Herein, the detection unit 13 detects the signal of the interface unit 11, namely detects the environment and the usage condition of the storage device 1.

The control unit 14 is adapted to control the updating of the total remaining amount of the recording material stored in the storage unit 12 and rewrite the rewritable remaining amount or the rewritable consumption of the recording material into a calculated value if the detection unit 13 detects that the signal of the interface unit 11 satisfies a predetermined trigger condition, and the total remaining amount of the recording material is more than the capacity of the recording material; the control unit 14 is further adapted to non-spontaneously update the remaining amount or the consumption of the recording material stored in the storage unit 12 if the total remaining amount of the recording material detected by the detection unit 13 is less than or equal to the capacity of the recording material.

In general, the control unit 14 is adapted to control the read-write of data in the storage unit 12 or the communication between the storage device 1 and the printing device 2.

If detecting the predetermined trigger condition, the detection unit 13 is cooperated with the control unit 14 to control the read-write of the data in the storage unit 12 or the communication between the storage device 1 and the printing device 2. In actual application, the detection unit 13 may also be integrated into the control unit 14, in which case the control unit 14 has the functions of read-write control and detection of the environmental condition.

The trigger condition is that the detection unit 13 detects the change of the signal supplied to the interface unit 11 by the printing device 2. The signal includes the voltage fall or voltage rise of the interface unit due to the switching of the printing device 2, the replacement of the consumable container, or the opening of a protective cover of the consumable container.

The trigger condition includes: for example, a clock signal becomes slow or fast or is maintained in a certain level; the rise of voltage of the power supply due to the supplying of the power after an interruption; a reset or enable port is activated and restored to a certain level; a boot initialization instruction is received; the change of the communication protocol during the initialization; the initialized read-write address and the like.

Figure 3:
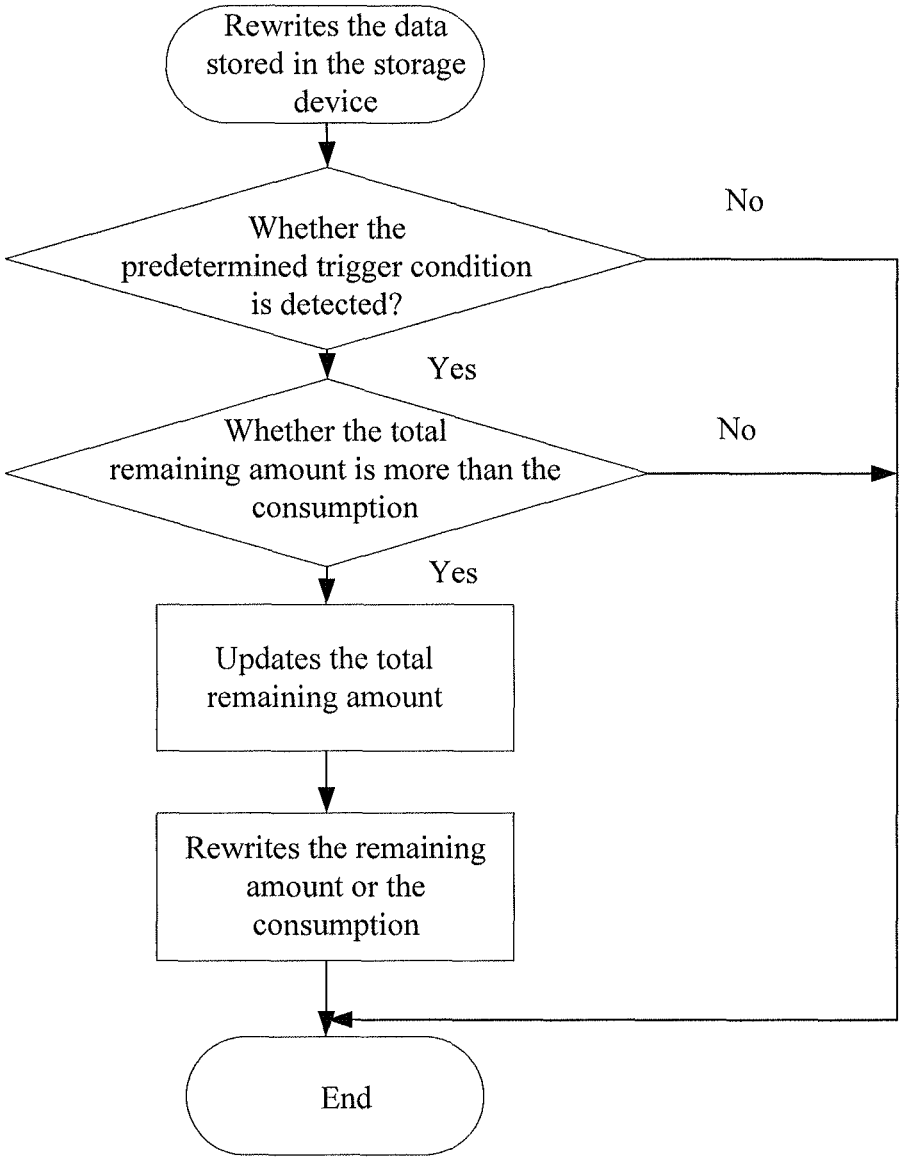
FIG. 3 is a control flow chart of a control unit according to an embodiment of the present invention.

Referring to FIG. 3, which is a control flow chart of the control unit according to the embodiment of the present invention.

After the storage device 1 of the embodiment of the present invention is mounted on the printing device 2, the detection unit 13 detects whether the predetermined trigger condition is generated.

If the predetermined trigger condition is detected, the step of comparing the total remaining amount and the capacity of the recording material is executed.

If the predetermined trigger condition is not detected, the data in the storage device 1 is not updated spontaneously.

In the step of comparing the total remaining amount and the capacity of the recording material, the control unit 14 compares the total remaining amount of the recording material with the capacity of the recording material.

The control unit 14 executes the step of updating the total remaining amount of the recording material if the total remaining amount of the recording material is more than the capacity of the recording material, and executes the step of rewriting the remaining amount or the consumption according to the further calculation result, namely rewriting the rewritable remaining amount or the rewritable consumption of the recording material into the calculated value.

If the total remaining amount of the recording material is less than or equal to the capacity of the recording material, the storage device 1 non-spontaneously updates the rewritable remaining amount or the rewritable consumption of the recording material except for an instruction from the printing device 2.

In the case that the rewriting of the data stored in the storage device 1 is completed, the storage device 1 cooperates t with the printing device 2 to execute the printing task and detects whether the predetermined trigger condition is generated until the storage device 1 stops working, namely the storage device 1 is prompted to stop working through the interface unit if the rewritable remaining amount or the rewritable consumption of the recording material stored in the storage unit indicates that the recording material is insufficient or is used up.

Alternatively, the function of the detection unit 13 may be forbidden if the total remaining amount of the recording material is less than or equal to the capacity of the recording material.

The control unit 14 may prompt the storage device 1 to stop working through the interface unit 11, if the rewritable remaining amount or the rewritable consumption of the recording material stored into the storage unit indicates that the recording material is insufficient or used up.

As described above, in the case that the total remaining amount of the recording material is more than the capacity of the recording material, the control unit 14 is able spontaneously modify the data relating to the recording material, and the number of the modification is not limited to a certain value, hence the probability of generating a large deviation can be effectively reduced. In the case that a certain amount of deviations is allowed, according to the further calculation result, the calculated value of the rewritable consumption of the recording material is equal to the value of the initial consumption of the recording material; or, the calculated value of the rewritable remaining amount of the recording material is equal to the value of the initial remaining amount of the recording material.

If the stored data relating to the recording material is required to be consistent with that of the recording material accommodated in the consumable container, the control method with higher precision is as follows.

Herein, the step of rewriting the remaining amount or the consumption according to the further calculation result, namely rewriting the rewritable remaining amount or the rewritable consumption of the recording material into the calculated value, includes:

the rewritable consumption of the recording material is rewritten into a value identical with the initial consumption of the recording material if the rewritable consumption of the recording material is less than or equal to a difference between the total remaining amount and the capacity of the recording material;

the rewritable consumption of the recording material is rewritten into a value identical with the initial consumption of the recording material if the variation of the consumption of the recording material is less than or equal to the difference between the total remaining amount and the capacity of the recording material; or the rewritable remaining amount of the recording material is rewritten into a value identical with the initial remaining amount of the recording material if the variation of the remaining amount of the recording material is less than or equal to a difference between the total remaining amount and the initial remaining amount of the recording material.

In another case, the step of rewriting the remaining amount or the consumption according to the further calculation result, namely rewriting the rewritable remaining amount or the rewritable consumption of the recording material into the calculated value, includes:

the rewritable consumption of the recording material is rewritten into a difference between the capacity and the updated total remaining amount of the recording material if the rewritable consumption of the recording material is more than the difference between the total remaining amount and the capacity of the recording material;

the rewritable consumption of the recording material is rewritten into the difference between the capacity and the updated total remaining amount of the recording material if the variation of the consumption of the recording material is more than the difference between the total remaining amount and the capacity of the recording material; or, the rewritable remaining amount of the recording material is rewritten into a value identical with the updated total remaining amount of the recording material if the variation of the remaining amount of the recording material is more than the difference between the total remaining amount and the initial remaining amount of the recording material.

The computing formula of updating the total remaining amount of the recording material is as follows:

the updated total remaining amount of the recording material=the total remaining amount of the recording material−the rewritable consumption of the recording material;

the updated total remaining amount of the recording material=the total remaining amount of the recording material−the variation of the consumption of the recording material; or, the updated total remaining amount of the recording material=the total remaining amount of the recording material−the variation of the remaining amount of the recording material.

In the above formulas, the variation of the consumption of the recording material refers to a difference between the rewritable consumption and the initial consumption of the recording material, and the variation of the remaining amount of the recording material refers to a difference between the initial remaining amount and the rewritable remaining amount of the recording material.

The computing formulas and the computing means are illustrated below by an example.

The storage device 1 is provided on the consumable container, herein the capacity of the recording material stored in the storage device 1 is 100 pages; the total remaining amount of the recording material is 150 pages; the initial remaining amount of the recording material is identical with the capacity of the recording material and is also 100 pages; the initial value of the rewritable remaining amount of the recording material is identical with the initial remaining amount of the recording material and is also 100 pages; or, the initial consumption of the recording material is 0 page and the initial value of the rewritable consumption of the recording material is 0 page. The consumable container is mounted on the printing device 2, the storage device 1 and the printing device 2 are communicated and cooperated with each other to execute a printing task.

After executing the task of printing 30 pages, the printing device 2 controls rewriting rewritable remaining amount of the recording material into 70 pages (i.e. 100−30=70), or rewriting the rewritable consumption of the recording material into 30 pages. After the printing device 2 completes the printing task and writes the latest usage condition of the recording material into the storage device 1, the clock frequency provided is lower and varied from 12 MHz to 6 MHz. The detection unit of the storage device 1 detects this predetermined trigger condition, and the step of comparing the total remaining amount of the recording material with the capacity of the recording material is executed. It is clear that the total remaining amount of the recording material (150 pages) is more than the capacity of the recording material (100 pages). Therefore, the total remaining amount of the recording material can be updated.

The specific algorithm of updating the total remaining amount of the recording material is as follows.

Based on the following computing formula:

the updated total remaining amount of the recording material=the total remaining amount of the recording material−the rewritable consumption of the recording material;

the updated total remaining amount of the recording material=the total remaining amount of the recording material−the variation of the consumption of the recording material; or, the updated total remaining amount of the recording material=the total remaining amount of the recording material−the variation of the remaining amount of the recording material.

Hence, the updated total remaining amount of the recording material=150−30=120 (pages);

the updated total remaining amount of the recording material=150−30=120 (pages); or, the updated total remaining amount of the recording material=150−30=120 (pages). It is clear that the calculating results are identical even if different parameters are adopted by the storage device 1.

In the case that a certain amount of deviations is allowed, according to the further calculation result, the calculated value of the rewritable consumption of the recording material is identical with the value of the initial consumption of the recording material, namely 0 page; or, the calculated value of the rewritable remaining amount of the recording material is identical with the value of the initial remaining amount of the recording material, namely 100 pages.

In the case that higher precision is required, the method includes:

the following operations are executed according to the further calculation result:

for the convenience of the description below, the following values are obtained firstly:

the variation of the consumption of the recording material=the rewritable consumption of the recording material−the initial consumption of the recording material=30−0=30 (pages);

the variation of the remaining amount of the recording material=the initial remaining amount of the recording material−the rewritable remaining amount of the recording material=100−70=30 (pages);

the difference between the total remaining amount of the recording material (150 pages) and the capacity of the recording material (100 pages) is 50 pages (150−100=50 pages); and the difference between the total remaining amount of the recording material (150 pages) and the initial remaining amount of the recording material (100 pages) is 50 pages (150−100=50 pages).

Since the rewritable consumption of the recording material (30 pages) is less than or equal to the difference (50 pages) between the total remaining amount and the capacity of the recording material, the rewritable consumption of the recording material (30 pages) is rewritten into a value (0 page) identical with the initial consumption of the recording material (0 page);

since the variation (30 pages) of the consumption of the recording material is less than or equal to the difference (50 pages) between the total remaining amount and the capacity of the recording material, the rewritable consumption of the recording material (30 pages) is rewritten into a value (0 page) identical with the initial consumption of the recording material (0 page); or, since the variation (30 pages) of the remaining amount of the recording material is less than or equal to the difference (50 pages) between the total remaining amount and the initial remaining amount of the recording material, the rewritable remaining amount of the recording material (70 pages) is rewritten into a value (100 pages) identical with the initial remaining amount of the recording material (100 pages).

After the above steps are executed, in the storage device 1, the capacity of the recording material is 100 pages, the initial remaining amount of the recording material is 100 pages, and the rewritable remaining amount of the recording material is 100 pages; Or, the initial consumption of the recording material is 0 page; the initial value of the rewritable consumption of the recording material is 0 page; and the total remaining amount of the recording material is 120 pages. It can be seen that the total remaining amount of the recording material among the parameters has been varied due to the printing of 30 pages.

Subsequently, the printing device 2 executes a task of printing 40 pages. After the printing is completed, the printing device 2 rewrites the rewritable remaining amount of the recording material to be 60 pages (i.e. 100−40=60) or rewrites the rewritable consumption of the recording material to be 40 pages. After the printing device 2 completes the printing task and writes the latest usage condition of the recording material into the storage device 1, the printing device 2 is turned off by a user. When the printing device 2 is turned on again, the voltage of the power supplied to the storage device 1 by the printing device 2 is raised after the interruption, and the detection unit of the storage device 1 detects this predetermined trigger condition, the step of comparing the total remaining amount of the recording material with the capacity of the recording material is executed. It is clear that the total remaining amount of the recording material (120 pages) is more than the capacity of the recording material (100 pages). Therefore, the total remaining amount of the recording material can be updated.

The specific algorithm of updating the total remaining amount of the recording material is as follows:

based on the following computing formula:

the updated total remaining amount of the recording material=the total remaining amount of the recording material−the rewritable consumption of the recording material; the updated total remaining amount of the recording material=the total remaining amount of the recording material−the variation of the consumption of the recording material; or, the updated total remaining amount of the recording material=the total remaining amount of the recording material−the variation of the remaining amount of the recording material.

For the convenience of the description below, the following values are obtained firstly:

the variation of the consumption of the recording material=the rewritable consumption of the recording material−the initial consumption of the recording material=40−0=40 (pages); and the variation of the remaining amount of the recording material=the initial remaining amount of the recording material−the rewritable remaining amount of the recording material=100−60=40 (pages).

Hence, the updated total remaining amount of the recording material=120−40=80 (pages);

the updated total remaining amount of the recording amount=120−40=80 (pages); or, the updated total remaining amount of the recording amount=120−40=80 (pages). It is clear that the calculation results are identical even if different parameters are adopted by the storage device 1.

The following operations are executed according to the further calculation result.

For the convenience of the description below, the following values are obtained firstly:

the difference between the total remaining amount of the recording material (120 pages) and the capacity of the recording material (100 pages) is 20 pages (120−100=20);

the difference between the total remaining amount of the recording material (120 pages) and the initial remaining amount of the recording material (100 pages) is 20 pages (120−100=20); and the difference between the capacity of the recording material (100 pages) and the updated total remaining amount of the recording material (80 pages) is 20 pages (100−80=20).

Since the rewritable consumption of the recording material (40 pages) is more than the difference (20 pages) between the total remaining amount and the capacity of the recording material, the rewritable consumption of the recording material (40 pages) is rewritten into the difference (20 pages) between the capacity and the updated total remaining amount of the recording material;

since the variation (40 pages) of the consumption of the recording material is more than the difference (20 pages) between the total remaining amount and the capacity of the recording material, the rewritable consumption of the recording material (40 pages) is rewritten into the difference (20 pages) between the capacity and the updated total remaining amount of the recording material; or, since the variation (40 pages) of the remaining amount of the recording material is more than the difference (20 pages) between the total remaining amount and the initial remaining amount of the recording material, the rewritable remaining amount of the recording material (60 pages) is rewritten into a value (80 pages) identical with the updated total remaining amount of the recording material.

After the above steps are executed, in the storage device 1, the capacity of the recording material is 100 pages, the initial remaining amount of the recording material is 100 pages, and the rewritable remaining amount of the recording material is 80 pages; Or, the initial consumption of the recording material is 0 page, the rewritable consumption of the recording material is 20 pages, and the total remaining amount of the recording material is 80 pages. It can be seen that the total remaining amount of the recording material has been varied due to the printing of 40 pages, and the rewritable remaining amount or the rewritable consumption of the recording material has also been varied as the total remaining amount of the recording material (80 pages) is less than the capacity of the recording material (100 pages). The detection unit of the storage device 1 may continue to detect the usage condition of the storage device 1 or the detection unit 13 is forbidden at the moment.

Subsequently, the printing device 2 executes a task of printing 40 pages. After the printing is completed, the printing device 2 rewrites the rewritable remaining amount of the recording material to be 40 pages (i.e. 80−40=40) or rewrites the rewritable consumption of the recording material to be 60 pages (i.e. 20+40=60). After the printing device 2 completes the printing task and writes the latest usage condition of the recording material into the storage device 1, the user removes the consumable device 3 from the printing device 2 and checks the usage condition of the consumable device 3, and then the consumable device 3 is mounted back on the printing device 2. The voltage of the power supplied to the storage device 1 by the printing device 2 is raised after the interruption, and if the detection unit of the storage device is not forbidden, the predetermined trigger condition can be detected, and the step of comparing the total remaining amount and the capacity of the recording material is executed. It is clear that the total remaining amount of the recording material (80 pages) is less than or equal to the capacity of the recording material (100 pages). The rewritable remaining amount or the rewritable consumption of the recording material is not spontaneously rewritten.

Repeating the above method, after the data stored in the storage device 1 is rewritten, the storage device 1 continues to cooperate with the printing device 2 to execute the printing task and detects whether the predetermined trigger condition is generated until the storage device 1 is scrapped, namely the rewritable remaining amount or the rewritable consumption of the recording material stored into the storage unit indicates that the recording material is insufficient or used up.

The storage device according to the first embodiment of the present invention is described by taking the total remaining amount of the recording material for example, which is a descending measurement mode. A storage device of a second embodiment of the present invention takes the accumulative consumption of the recording material for example, namely adopting an ascending measurement mode. If the accumulative consumption of the recording material reaches a predetermined value (the additional amount of the recording material), the rewritable remaining amount or the rewritable consumption of the recording material is not spontaneously rewritten.

The structure of modules of the storage device in the second embodiment of the present invention is as illustrated in FIG. 1. The functions and the connection relations of various units are as described in the first embodiment and will not be described further herein.

The storage device of the second embodiment differs from that of the first embodiment in follows, the storage unit 12 is adapted to store the target consumption of the recording material, the accumulative consumption of the recording material, the capacity of the recording material, the initial remaining amount or the initial consumption of the recording material, and the rewritable remaining amount or the rewritable consumption of the recording material;

a control unit 14 is adapted to update the accumulative consumption of the recording material stored in the storage unit 12 and rewrite the rewritable remaining amount or the rewritable consumption of the recording material into a calculated value if a detection unit 13 detects a predetermined trigger condition and the accumulative consumption of the recording material is less than the additional amount of the recording material; and the control unit non-spontaneously updates the remaining amount or the consumption of the recording material stored in the storage unit if the accumulative consumption of the recording material is more than or equal to the additional amount of the recording material.

If the accumulative consumption of the recording material is more than or equal to the additional amount of the recording material, the storage device non-spontaneously updates the rewritable remaining amount or the rewritable consumption of the recording material again except for an instruction from a printing device. After rewriting the data in the storage device, the storage device continues to cooperate with the printing device to execute the printing task and detect whether the predetermined trigger condition is generated until the storage device stops working. That is to say, the storage device is prompted to stop working through the interface unit in the case that the rewritable remaining amount or the rewritable consumption of the recording material stored in the storage unit indicates that the recording material is insufficient or used up.

Alternatively, the functions of the detection unit 13 may also be forbidden in the case that the accumulative consumption of the recording material is more than or equal to the additional amount of the recording material. In addition, the control unit 14 may prompt the storage device to stop working through the interface unit 11 in the case that the rewritable remaining amount or the rewritable consumption of the recording material stored in the storage unit 12 indicates that the recording material is insufficient or used up.

The additional amount of the recording material refers to a difference between the target consumption and the capacity of the recording material.

The predetermined trigger condition is identical with that of the first embodiment and will not be described further herein.

The specific algorithm of updating the accumulative consumption of the recording material is as follows:

the updated accumulative consumption of the recording material=the accumulative consumption of the recording material+the rewritable consumption of the recording material;

the updated accumulative consumption of the recording material=the accumulative consumption of the recording material+the variation of the consumption of the recording material; or, the updated accumulative consumption of the recording material=the accumulative consumption of the recording material+the variation of the remaining amount of the recording material.

Herein, the variation of the consumption of the recording material refers to a difference between the rewritable consumption and the initial consumption of the recording material, and the variation of the remaining amount of the recording material refers to a difference between the initial remaining amount and the rewritable remaining amount of the recording material.

In the case that a certain amount of deviations is allowed, the process of rewriting into a calculated value includes:

the calculated value of the rewritable consumption of the recording material is a value identical with the initial consumption of the recording material; or, the calculated value of the rewritable remaining amount of the recording material is a value identical with the initial remaining amount of the recording material.

Therefore, the target consumption and the capacity of the recording material may be not stored in the storage unit, and only the difference between the target consumption and the capacity of the recording material, namely the additional amount of the recording material, is stored.

In the case that higher precision is required, the process of rewriting into a calculated value includes:

the rewritable consumption of the recording material is rewritten into a value identical with the initial consumption of the recording material in the case that the updated accumulative consumption of the recording material is less than the additional amount of the recording material; or, the rewritable remaining amount of the recording material is rewritten into a value identical with the initial remaining amount of the recording material in the case that the updated accumulative consumption of the recording material is less than the additional amount of the recording material.

In another case, the rewritable consumption of the recording material is rewritten into a difference between the capacity and the remaining consumable amount of the recording material in the case that the updated accumulative consumption of the recording material is more than or equal to the additional amount of the recording material, or, the rewritable remaining amount of the recording material is rewritten into a value identical with the remaining consumable amount of the recording material in the case that the updated accumulative consumption of the recording material is more than or equal to the additional amount of the recording material.

Herein, the remaining consumable amount of the recording material refers to a difference between the target consumption and the updated accumulative consumption of the recording material.

According to the invention, it is provided a consumable container including any one of the above storage devices.

The consumable container may be an ink cartridge, a toner cartridge, a cartridge, a drum component and any other container used for accommodating a recording material used for printing and imaging.

The foregoing is only the preferred embodiments of the present invention and not construed as to limit the present invention in any form. Although the preferred embodiments of the present invention have been described above, they are not intended to limit the present invention. Various possible variations and modifications can be made to the technical proposals of the present invention by those skilled in the art on the basis of the methods and the technical contents disclosed above without departing from the scope of the technical proposals of the present invention, or the technical proposals of the present invention can be modified into equivalent embodiments with equivalent change. For example, in the technical proposals of the present invention, in the case that the control unit non-spontaneously updates the rewritable remaining amount or the rewritable consumption of the recording material, if the current rewritable remaining amount or the current rewritable consumption of the recording material is simply rewritten once, or rewritten once after the addition or subtraction of one unit amount, and both the two means may be construed as to be equivalent to the invention. Therefore, any simple modification and equivalent change and modification made to the above embodiments on the basis of the technical essence of the invention without departing from the contents of the technical proposals of the invention shall all fall within the scope of protection of the technical proposals of the invention.

The invention claimed is:

1. A storage device applied in a printer, comprising:

an interface unit adapted to establish a communication connection between the storage device and the printer, wherein the interface unit comprises a plurality of connecting terminals or an antenna;

a storage unit, adapted to store a total remaining amount of a recording material and a capacity of the recording material, an initial remaining amount of the recording material and/or an initial consumption of the recording material, and a rewritable remaining amount of the recording material and/or a rewritable consumption of the recording material;

a detection unit, adapted to detect a signal of the interface unit; and a control unit, adapted to control updating the total remaining amount of the recording material stored in the storage unit, rewrite the rewritable remaining amount of the recording material into a calculated value of the rewritable remaining amount of the recording material or rewrite the rewritable consumption of the recording material into a calculated value of the rewritable consumption of the recording material, in the case that the detection unit detects a predetermined trigger condition and the total remaining amount of the recording material is more than the capacity of the recording material; and adapted to non-spontaneously update the remaining amount of the recording material or the consumption of the recording material stored in the storage unit in the case that the total remaining amount of the recording material is less than or equal to the capacity of the recording material, wherein the interface unit, the storage unit, the detection unit, and the control unit are formed on a printed circuit board.

2. The storage device according to claim 1, wherein the predetermined trigger condition is that the detection unit detects a change of a signal transmitted to the interface unit by the printer, wherein the signal comprises voltage fall or voltage rise of the interface unit due to switching of the printer, replacement of a consumable container, or opening of a protective cover of the consumable container.

3. The storage device according to claim 1, wherein the capacity of the recording material is identical with the initial remaining amount of the recording material, the capacity of the recording material and the initial remaining amount of the recording material are a same parameter, or the capacity of the recording material is identical with a maximum of the rewritable consumption of the recording material.

4. The storage device according to claim 1, wherein the calculated value of the rewritable consumption of the recording material is identical with a value of the initial consumption of the recording material; or the calculated value of the rewritable remaining amount of the recording material is identical with the value of the initial remaining amount of the recording material.

5. The storage device according to claim 1, wherein an updated total remaining amount of the recording material=the total remaining amount of the recording material−the rewritable consumption of the recording material, the updated total remaining amount of the recording material=the total remaining amount of the recording material−a variation of the consumption of the recording material, or the updated total remaining amount of the recording material=the total remaining amount of the recording material−a variation of the remaining amount of the recording material.

6. The storage device according to claim 5, wherein the calculated value comprises:

the calculated value of the rewritable consumption of the recording material is identical with a value of the initial consumption of the recording material in the case that the rewritable consumption of the recording material is less than or equal to a difference between the total remaining amount of the recording material and the capacity of the recording material, the calculated value of the rewritable consumption of the recording material is identical with the value of the initial consumption of the recording material in the case that the variation of the consumption of the recording material is less than or equal to the difference between the total remaining amount of the recording material and the capacity of the recording material, or the calculated value of the rewritable remaining amount of the recording material is identical with a value of the initial remaining amount of the recording material in the case that the variation of the remaining amount of the recording material is less than or equal to a difference between the total remaining amount of the recording material and the initial remaining amount of the recording material;

the calculated value of the rewritable consumption of the recording material is identical with a difference between the capacity of the recording material and the updated total remaining amount of the recording material in the case that the rewritable consumption of the recording material is more than the difference between the total remaining amount of the recording material and the capacity of the recording material, the calculated value of the rewritable consumption of the recording material is identical with the difference between the capacity of the recording material and the updated total remaining amount of the recording material in the case that the variation of the consumption of the recording material is more than the difference between the total remaining amount of the recording material and the capacity of the recording material, or the calculated value of the rewritable remaining amount of the recording material is identical with the updated total remaining amount of the recording material in the case that the variation of the remaining amount of the recording material is more than the difference between the total remaining amount of the recording material and the initial remaining amount of the recording material;

wherein the variation of the consumption of the recording material is a difference between the rewritable consumption of the recording material and the initial consumption of the recording material, and the variation of the remaining amount of the recording material is a difference between the initial remaining amount of the recording material and the rewritable remaining amount of the recording material.

7. A consumable container, comprising a storage device applied in a printer, the storage device comprising:

an interface unit adapted to establish a communication connection between the storage device and the printer, wherein the interface unit comprises a plurality of connecting terminals or an antenna;

a storage unit, adapted to store a total remaining amount of a recording material and a capacity of the recording material, an initial remaining amount of the recording material and/or an initial consumption of the recording material, and a rewritable remaining amount of the recording material and/or a rewritable consumption of the recording material;

a detection unit, adapted to detect a signal of the interface unit; and a control unit, adapted to control updating the total remaining amount of the recording material stored in the storage unit, rewrite the rewritable remaining amount of the recording material into a calculated value of the rewritable remaining amount of the recording material or rewrite the rewritable consumption of the recording material into a calculated value of the rewritable consumption of the recording material, in the case that the detection unit detects a predetermined trigger condition and the total remaining amount of the recording material is more than the capacity of the recording material; and adapted to non-spontaneously update the remaining amount of the recording material or the consumption of the recording material stored in the storage unit in the case that the total remaining amount of the recording material is less than or equal to the capacity of the recording material, wherein the interface unit, the storage unit, the detection unit, and the control unit are formed on a printed circuit board.

8. The consumable container according to claim 7, wherein the predetermined trigger condition is that the detection unit detects a change of a signal transmitted to the interface unit by the printer, wherein the signal comprises voltage fall or voltage rise of the interface unit due to switching of the printer, replacement of a consumable container, or opening of a protective cover of the consumable container.

9. The consumable container according to claim 7, wherein the capacity of the recording material is identical with the initial remaining amount of the recording material, the capacity of the recording material and the initial remaining amount of the recording material are a same parameter, or the capacity of the recording material is identical with a maximum of the rewritable consumption of the recording material.

10. The consumable container according to claim 7, wherein the calculated value of the rewritable consumption of the recording material is identical with a value of the initial consumption of the recording material; or the calculated value of the rewritable remaining amount of the recording material is identical with the value of the initial remaining amount of the recording material.

11. The consumable container according to claim 7, wherein an updated total remaining amount of the recording material=the total remaining amount of the recording material−the rewritable consumption of the recording material, the updated total remaining amount of the recording material=the total remaining amount of the recording material−a variation of the consumption of the recording material, or the updated total remaining amount of the recording material=the total remaining amount of the recording material−a variation of the remaining amount of the recording material.

12. The consumable container according to claim 7, wherein the calculated value comprises:

the calculated value of the rewritable consumption of the recording material is identical with a value of the initial consumption of the recording material in the case that the rewritable consumption of the recording material is less than or equal to a difference between the total remaining amount of the recording material and the capacity of the recording material, the calculated value of the rewritable consumption of the recording material is identical with the value of the initial consumption of the recording material in the case that the variation of the consumption of the recording material is less than or equal to the difference between the total remaining amount of the recording material and the capacity of the recording material, or the calculated value of the rewritable remaining amount of the recording material is identical with a value of the initial remaining amount of the recording material in the case that the variation of the remaining amount of the recording material is less than or equal to a difference between the total remaining amount of the recording material and the initial remaining amount of the recording material;

the calculated value of the rewritable consumption of the recording material is identical with a difference between the capacity of the recording material and the updated total remaining amount of the recording material in the case that the rewritable consumption of the recording material is more than the difference between the total remaining amount of the recording material and the capacity of the recording material, the calculated value of the rewritable consumption of the recording material is identical with the difference between the capacity of the recording material and the updated total remaining amount of the recording material in the case that the variation of the consumption of the recording material is more than the difference between the total remaining amount of the recording material and the capacity of the recording material, or the calculated value of the rewritable remaining amount of the recording material is identical with the updated total remaining amount of the recording material in the case that the variation of the remaining amount of the recording material is more than the difference between the total remaining amount of the recording material and the initial remaining amount of the recording material;

wherein the variation of the consumption of the recording material is a difference between the rewritable consumption of the recording material and the initial consumption of the recording material, and the variation of the remaining amount of the recording material is a difference between the initial remaining amount of the recording material and the rewritable remaining amount of the recording material.

* * * * *